United States Patent [19]

Bühler

[11] 4,255,126

[45] Mar. 10, 1981

[54] FURNACE TILTING DEVICE

[75] Inventor: Karl Bühler, Nussbaumen, Switzerland

[73] Assignee: BBC Brown Boveri & Company Limited, Baden, Switzerland

[21] Appl. No.: 80,772

[22] Filed: Sep. 28, 1979

[30] Foreign Application Priority Data

Sep. 28, 1978 [CH] Switzerland ..... 10120/78

[51] Int. Cl.[3] ..... F27B 14/02; C21C 5/42

[52] U.S. Cl. ..... 432/1; 266/244; 432/157

[58] Field of Search ..... 432/1, 9, 157, 160; 266/244, 245; 91/520, 533; 92/68

[56] References Cited

U.S. PATENT DOCUMENTS

| | | | |
|---|---|---|---|
| 3,684,261 | 8/1972 | Wynne | 432/160 |
| 3,774,696 | 11/1973 | Horsch | 91/520 |
| 3,790,338 | 2/1974 | Duca | 432/157 |
| 4,074,611 | 2/1978 | Hereth | 92/68 |

*Primary Examiner*—John J. Camby

*Attorney, Agent, or Firm*—Burns, Doane, Swecker & Mathis

[57] ABSTRACT

A method and apparatus for tilting a furnace supported by rolling rockers is disclosed. The apparatus includes at least one hydraulic cylinder connected to a spout side of the furnace, and at least one hydraulic cylinder connected to a back side of the furnace.

9 Claims, 3 Drawing Figures

FURNACE TILTING DEVICE

BACKGROUND AND SUMMARY OF THE PRESENT INVENTION

The invention disclosed herein pertains generally to tilting devices, and more particularly to a tilting device for a furnace positioned on rolling rockers.

It is known in the furnace art to use hydraulic cylinders as tilting devices for furnaces arranged on rolling rockers. Typically, these hydraulic cylinders are positioned on a side of a furnace opposite to a spout side, and are arranged between a foundation which supports the furnace, and the furnace itself. This is illustrated, for example, in the prospectus "Brown Boveri - Lichtbogenöfen der Bauart SSKD" page 9, undated. A similar tilting device is described in FR-PS No. 2,113,198, where a rack is used instead of an hydraulic cylinder. Depending on the shape of the rocker geometry, the furnaces are either self-righting, i.e. stable, or have a backwardly directed moment. With respect to the former, double-acting cylinders or racks are employed, whereas with the latter it is possible to use single-acting cylinders.

A disadvantage of the known tilting devices is that a magnitude of a force necessary for a movement of a furnace depends on a length of a lever arm, which length is equal to a distance between a contact point of a pair of rolling rockers on a set of movable beams and a point of application of the foce. A length of the lever arm is especially small during a backward tilting of the furnace so that a correspondingly large force must be applied.

The disadvantage associated with the known tilting devices described above is particularly noticeable in the case of self-righting furnaces. With self-righting furnaces a double acting drive mechanism must pull the furnace into a backwardly tilted position against a righting moment. If hydraulic cylinders each having a piston are used as the drive mechanism, then an effective area over which hydraulic pressure may be applied is the area of the piston less a cross-sectional area of the associated piston rod. Therefore the cylinders must necessarily have relatively large dimensions. This is uneconomical and undesirable in terms of space considerations.

Accordingly, a primary object of the present invention is to provide a reliable tilting device for a furnace positioned on rolling rockers, which tilting device includes at least one drive mechanism whose dimensions are relatively small.

Apparatus for tilting a furnace arranged on rolling rockers, according to the present invention, includes at least one drive mechanism arranged adjacent a back-tilting side of the furnace, and at least one drive mechanism arranged adjacent a spout side of the furnace.

An advantage of the present invention is that, regardless of the tilting position of the furnace, either the at least one drive mechanism on the back-tilting side of the furnace or the at least one drive mechanism on the spout side of the furnace may take advantage of a relatively long lever arm. Thus a specified tilting moment may be achieved by means of a relatively long lever arm and relatively small force so that the drive mechanisms may have relatively small dimensions.

A preferred embodiment of the present invention includes drive mechanisms which employ hydraulic cylinders.

Another preferred embodiment of the present invention includes drive mechanisms which employ double-acting hydraulic cylinders, i.e., cylinders capable of exerting a force in either one of two opposed directions.

By using an hydraulic cylinder on each side of a furnace, the hydraulic cylinder on one side of the furnace is subjected to a compressive stress while the hydraulic cylinder on the other side of the furnace is subjected to a tensile stress. The forces exerted by each of the cylinders mutually reinforce one another, particularly with self-righting furnaces, because advantage is taken of the fact that the cylinder stressed in compression can produce a greater moment since it acts on a longer lever arm.

Yet another preferred embodiment of the present invention includes a drive mechanism having an hydraulic cylinder arranged on each side of a furnace, wherein a lower chamber of one cylinder is connected to, i.e., in communication with, an upper chamber of the other cylinder, and vice versa. This embodiment makes possible a simple control of the cylinders.

Yet a further preferred embodiment of the present invention includes two or more drive mechanisms at a spout side of a furnace with but one drive mechanism at a back-tilting side of the furnace, or two or more drive mechanisms at the back-tilting side of the furnace with but one drive mechanism at the spout side. This preferred embodiment of the present invention also includes two or more drive mechanisms respectively at the spout side of the furnace and at the back-tilting side of the furnace. This embodiment makes it possible to arrange the drive mechanism laterally in the region of the rolling rockers.

BRIEF DESCRIPTION OF THE DRAWINGS

A preferred embodiment of the present invention is described with reference to the accompanying drawings wherein.

DETAILED DESCRIPTION OF THE PREFERRED EMBODIMENT

Figure 1:
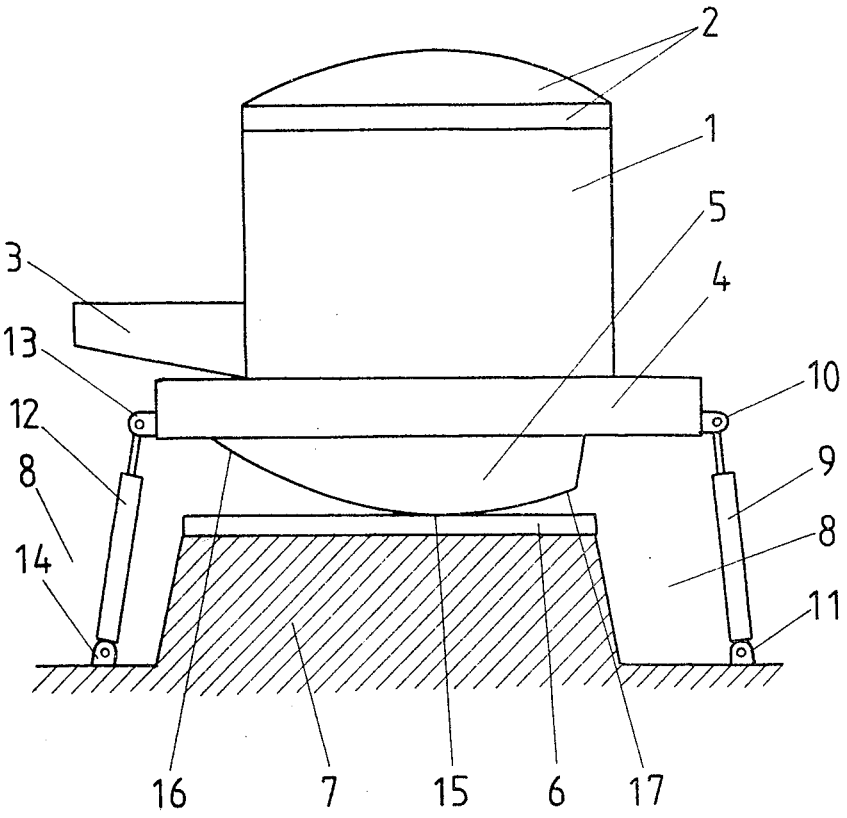
FIG. 1 is a front view of a furnace having a tilting device, according to the present invention.

With reference to FIG 1, a furnace vessel 1 with a furnace cover 2 and a pouring lip 3 is secured to a supporting structure 4. The supporting structure 4 is supported by two rolling rockers 5, of which two rolling rockers only one is visible in the drawing. Rocker beams 6, which are secured to a foundation 7, serve as supports for the rolling rockers 5.

Recesses 8 for one or more double-acting hydraulic cylinders 9 (only one of which is shown) at a back-tilting side of the furnance and for one or more double-acting hydraulic cylinders 12 (only one of which is shown) at a spout side of the furnace are included in the foundation 7. The cylinders 9 at the back-tilting side are connected to the supporting structure 4 through respective piston rods and upper bearings 10 and are connected to the foundation 7 through lower bearings 11. The cylinders 12 at the spout side are connected to the supporting structure 4 and the foundation 7 through respective upper bearings 13 and lower bearings 14.

A middle contact point of the rolling rockers 5 with the rocker beams 6 is denoted by the reference numeral 15. A contact point of the rolling rockers 5 with the rocker beams 6 during a pouring operation is denoted by the numeral 16, while a contact point of the rolling rockers 5 with the rocker beams 6 during a slagging off operation is denoted by the numeral 17.

The embodiment of the invention described above is used as follows. If the furnace vessel 1 is to be rotated into a pouring position then the double-acting hydraulic cylinders 9 at the back tilting side exert an upward force on the supporting structure 4, while the double-acting hydraulic cylinders 12 at the spout side exert a downward force (see FIG. 2*b*). The cylinders 9 thus experience a compressive stress, while the cylinders 12 experience a tensile stress. Furthermore, the force exerted by the cylinder 9 will be relatively small because a distance between a point of application of the force and a contact point between the rolling rockers 5 and the rocker beams 6 is relatively large, i.e., a length of a lever arm over which the force exerted by the cylinders 9 acts is relatively large.

Figure 2A:
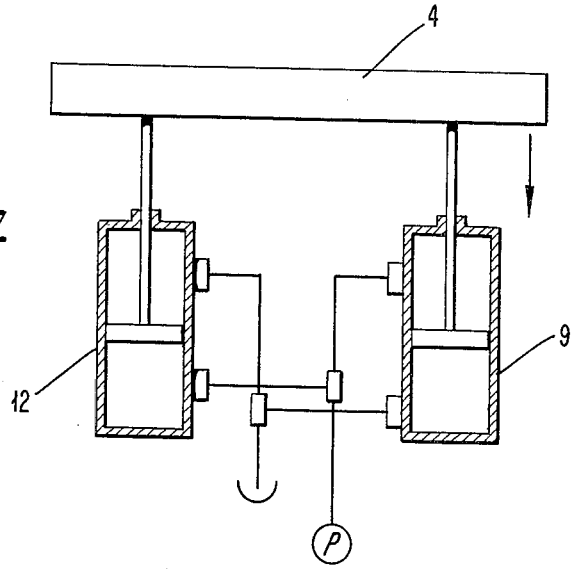
FIG. 2*a* is a schematic view of the hydraulic cylinder arrangement of the embodiment of FIG. 1 with a cylinder 12 at a spout side of the furnace exerting an upward force.
Figure 2B:
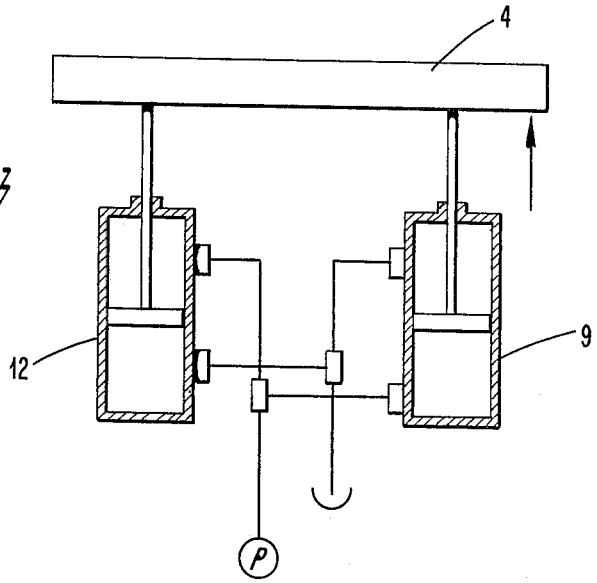
FIG. 2*b* is a schematic view of the hydraulic cylinder arrangement of the embodiment of FIG. 1 with a cylinder 9 at a back-tilting side of the furnace exerting an upward force.

During a back-tilting of the furnace vessel 1 the roles of the double-acting hydraulic cylinders 9 and 12 are reversed (see FIG. 2*a*).

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. Apparatus for tilting a two-way tilting furnace with a spout side and a back-tilting side, comprising:

at least one rolling rocker upon which the furnace is support;

base means for supporting said at least one rolling rocker with a point of contact defined between said at least one rolling rocker and said base means, said point of contact moving toward said spout side as said furnace is tilted toward the spout side and moving toward said back-tilting side as said furnace is tilted toward the back-tilting side;

first means for selectively exerting a first force at the back-tilting side of the furnace in an upward direction;

second means for selectively exerting a second force, in a downward direction and simultaneously with said first force, at the spout side of the furnace whereby said furnace may be selectively tilted to a pouring position with both an effective lever arm of said first force on said furnace about said point of contact progressively increasing in magnitude and an effective lever arm of said second force on said furance about said point of contact progressively decreasing in magnitude, as said point of contact moves toward the spout side;

third means for selectively exerting a third force at the spout side of the furnace in an upward direction; and fourth means for selectively exerting a fourth force, in a downward direction simultaneously with said third force, at the back-tilting side of the furnace, whereby said furnace may be selectively tilted to a back-tilting position, with both an effective lever arm of said third force on said furnace about said point of contact progressively increasing in magnitude and an effective lever arm of said fourth force on said furnace about said point of contact progressively decreasing in magnitude, as said point of contact moves toward the back-tilting side.

2. Apparatus in accordance with claim 1 wherein said first though fourth means each includes at least one hydraulic cylinder.

3. Apparatus in accordance with claim 1 wherein said first and fourth means include at least one double-acting hydraulic cylinder and said second and third means include at least one double-acting hydraulic cylinder.

4. Apparatus in accordance with claim 3 wherein a lower chamber of the at least one double-acting hydraulic cylinder of the first and fourth means is in communication with an upper chamber of the at least one double-acting hydraulic cylinder of the second and third means, and an upper chamber of the at least one double-acting hydraulic cylinder of the first and fourth means is in communication with a lower chamber of the at least one double-acting hydraulic cylinder of the second and third means.

5. Apparatus in accordance with claim 1 wherein said first means includes at least two separate, spaced-apart hydraulic cylinders.

6. Apparatus in accordance with claim 1 wherein said third means includes at least two separate, spaced-apart hydraulic cylinders.

7. A method for tilting a furnace supported by at least one rolling rocker, which furnace includes a spout side and a back-tilting side, comprising the steps of:

selectively exerting a first force at the back-tilting side of the furnce generally upwardly and simultaneously exerting a second force, generally downwardly, at the spout side of the furnace, to tilt the furnace to a pouring position with an effective lever arm of said first force on said furnace about a point of contact with said at least one rolling rocker increasing and an effective lever arm of said second force on said furnace about said point of contact decreasing as said furnace is tilted to the pouring position; and selectively exerting a third force at the spout side of the furnace generally upwardly and simultaneously exerting a fourth force, generally downwardly at the back-tilting side of the furnace, to tilt the furnace to a back-tilting position with an effective lever arm of said third force on said furnace about said point of contact with said at least one rolling rocker increasing and an effective lever arm of said fourth force on said furnace about said point of contact with said point of contact decreasing as said furnace is tilted to the back-tilting position.

8. Apparatus for tilting a furnace vessel of a two-way tilting furnace with a spout side and a back-tilting side, comprising:

base means for supporting said two-way tilting furnace, said base means including a foundation with at least one rocker beam mounted on the foundation;

rolling rocker means for supporting said furnace vessel including at least one rolling rocker carried by the rocker beam, said at least one rolling rocker having a support structure which carries the furnace vessel;

a first double-acting hydraulic cylinder provided at the spout side of the furnace;

a second double-acting hydraulic cylinder provided at the back tilting side of the furnace, wherein said first and said second double-acting hydraulic cylinders each have an upper cylinder chamber and a lower cylinder chamber such that the upper cylinder chamber of the first double-acting hydraulic cylinder is in communication with the lower cylinder chamber of the second double-acting hydraulic cylinder and the upper cylinder chamber of the second double-acting hydraulic cylinder is in communication with the lower cylinder chamber of the first double-acting hydraulic cylinder; and bearing means for connecting said first and said second double-acting hydraulic cylinders with the base means and with the rolling rocker means.

9. The apparatus of claim 8 wherein the bearing means comprises:

a first upper bearing secured to a spout side of the support structure;

a second upper bearing secured to a back tilting side of the support structure;

a first lower bearing secured to a spout side of the foundation; and a second lower bearing secured to a back-tilting side of the foundation;

said first and second double acting hydraulic cylinders being connected with the rolling rocker means by the first and second upper bearings and being connected with the base means by the first and second lower bearings.

* * * * *